US005539629A

United States Patent [19]

Chinniah et al.

[11] Patent Number: 5,539,629

[45] Date of Patent: Jul. 23, 1996

[54] MULTI-FACETED LIGHT REFLECTOR FOR HEADLAMP WITH FACETS HAVING DIFFERENTIALLY TILTED PARABOLIC CYLINDERS

[75] Inventors: Jeyachandrabose Chinniah, Ann Arbor; Prasad M. Koppolu, Farmington Hills; Amir M. Fallahi, Holly, all of Mich.

[73] Assignee: Ford Motor Company, Dearborn, Mich.

[21] Appl. No.: 434,212

[22] Filed: May 4, 1995

[51] Int. Cl.[6] ..... F21V 7/00

[52] U.S. Cl. ..... 362/297

[58] Field of Search ..... 362/297, 309

[56] References Cited

U.S. PATENT DOCUMENTS

| | | | |
|---|---|---|---|
| 4,061,422 | 12/1977 | Geurts et al. . | |
| 4,087,682 | 5/1978 | Kolodziej | 362/297 |
| 4,412,276 | 10/1983 | Blinow . | |
| 4,460,942 | 7/1984 | Pizzuti et al. . | |
| 4,704,661 | 11/1987 | Kosmatka . | |
| 5,117,343 | 5/1992 | Kerscher et al. | 362/297 |
| 5,142,459 | 8/1992 | Swarens et al. . | |
| 5,452,191 | 9/1995 | Lopez | 362/297 |

*Primary Examiner*—Carroll B. Dority
*Attorney, Agent, or Firm*—Kevin G. Mierzwa

[57] ABSTRACT

A multi-faceted light reflector has a reflecting surface with a plurality of adjacent facets, a light source placed in a predetermined spatial relationship to the reflecting surface, and an image surface placed in a predetermined spatial relationship to the light source and the reflecting surface. At least one of said facets has a differentially tilted parabolic cross section. The differentially tilted parabolic facet has a continuous and smooth surface with a focal axis having an angle of inclination with respect to the horizontal image surface that changes along the length of the facet.

12 Claims, 3 Drawing Sheets

MULTI-FACETED LIGHT REFLECTOR FOR HEADLAMP WITH FACETS HAVING DIFFERENTIALLY TILTED PARABOLIC CYLINDERS

BACKGROUND OF THE INVENTION

The present invention relates generally to light reflectors for exterior automotive lighting applications and more specifically to a multi-faceted light reflector for a headlamp having facets formed by differentially tilted parabolic cylinders.

Several methods are known for controlling the light distribution from a light reflector. In U.S. Pat. No. 4,825,343, a projector headlamp has a reflective surface with a series of minute planar face elements to direct light from a light source in front of the reflecting surface to a predetermined region on a shade. The shade masks a portion of the light output from the headlamp. The face elements are arranged in a series of adjacent vertical columns to form the reflective surface. Each face element in a vertical column is aimed at a common point on the shade.

The '343 patent has several embodiments which describe the mirrored surface as having distinct regions providing different light directing functions. The functions of some of the regions change drastically from their adjacent regions. These drastic changes in function generally result in either a discontinuity between adjacent vertical columns or a misdirection of light. One drawback to such a system is that light distribution cannot be precisely controlled since a shade must be employed to block out a portion of the light output from the bulb, i.e., light having an upward directional component. Another drawback to such a system is that discontinuities between the individual steps on the surface of the base structure surface promotes the buildup of reflective coating that is adhered to the surface during manufacturing by spraying, resulting in undesirable light scattering. Yet another drawback to such a projector type headlamp is that the light pattern is of such a shape that a convex lens must be employed to obtain a proper light distribution pattern.

U.S. Pat. No. 4,704,661 describes a multi-faceted headlamp reflector having distinct bending and spreading facets formed of right and simple parabolic sections. The parabolic facet size is a function of the amount of bending and spreading required. Because the parabolic section size is directly dependent on its light directing function, the overall package size is fixed which allows little flexibility in overall design. Another drawback to such a configuration is that distinct steps are formed by the bending and spreading facets. The stepped facets have the drawback that when the facets are sprayed with reflective coating, the reflective coating tends to build up on the corners of the edges of each step and cause an uncontrolled diffusion of the light.

A multifaceted design such as that disclosed in commonly assigned U.S. patent application Ser. No. 08/254,716, describes a reflective surface having facets whose shape is controlled to so that each facet edge aligns with the adjacent facet edge. For particular applications, the facet size must be made very small relative to the tooling. It has been found in the manufacture of the reflective surface that the size of the facets has a particular lower limit due to tooling tolerances and the smoothing effects of spraying a reflective coating over the surface. When the facets are made larger, tilting the facets in a horizontal or vertical direction does not yield desired results.

In automotive design, lighting engineers are typically given a package size to work within. Lighting engineers are increasingly given reduced package sizes while still having to maintain a required light distribution. It would therefore be desirable to provide a light reflector without having stepped surfaces to control the light output.

SUMMARY OF THE INVENTION

One advantage of the present invention is that facets can be shaped large enough to prevent smoothing from the manufacturing process yet provide accurate light distribution while still allowing design flexibility in the overall package design.

The present invention has a reflecting surface with a plurality of adjacent facets, a light source placed in a predetermined spatial relationship to the reflecting surface, and an image surface placed in a predetermined spatial relationship to the light source and the reflecting surface. At least one of the facets have a differentially tilted parabolic cross section. The differentially tilted parabolic facet has a continuous and smooth surface with a focal axis having an angle of inclination with respect to the horizontal image surface that changes as the horizontal distance from the light source increases.

BRIEF DESCRIPTION OF THE DRAWINGS

FIG. 6 is a graphical representation of the light distribution of a headlamp while in the low beam state.

FIG. 7 is a graphical representation of light distribution of a headlamp according to the present invention in the high beam state.

DETAILED DESCRIPTION OF THE PREFERRED EMBODIMENT

Figure 1:
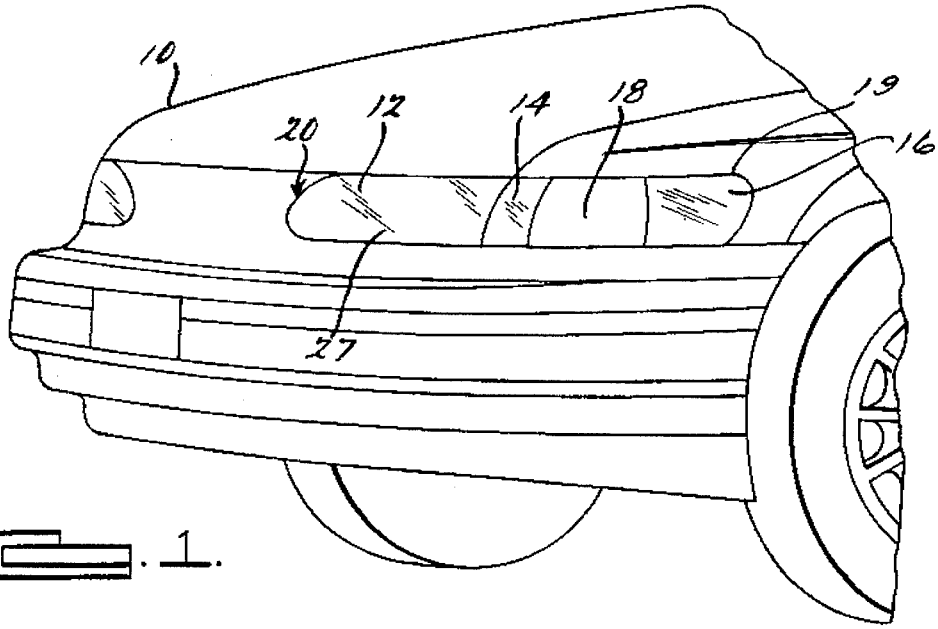
FIG. 1 is a perspective view of a front corner of an automobile having a cornering lamp and headlamp according to the present invention.

Referring to FIG. Is an automotive vehicle 10 has a headlamp assembly 12, a turn signal 14, a cornering lamp 16, and a retro-reflector 18. Headlamp assembly 12 is used to illuminate a horizontal planar road surface (not shown) in front of vehicle 10. A headlamp cover 27 which is preferably optimally neutral encloses headlamp assembly 12. Turn signal 14, cornering lamp 16, and retro-reflector 18 are enclosed within a common housing 19.

Figure 2:
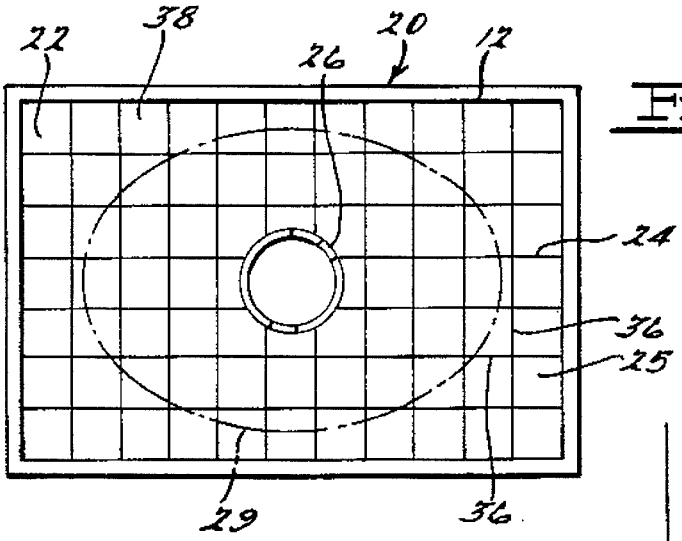
FIG. 2 is a front view of a faceted surface of a headlamp according to the preferred embodiment of the present invention.
Figure 3:
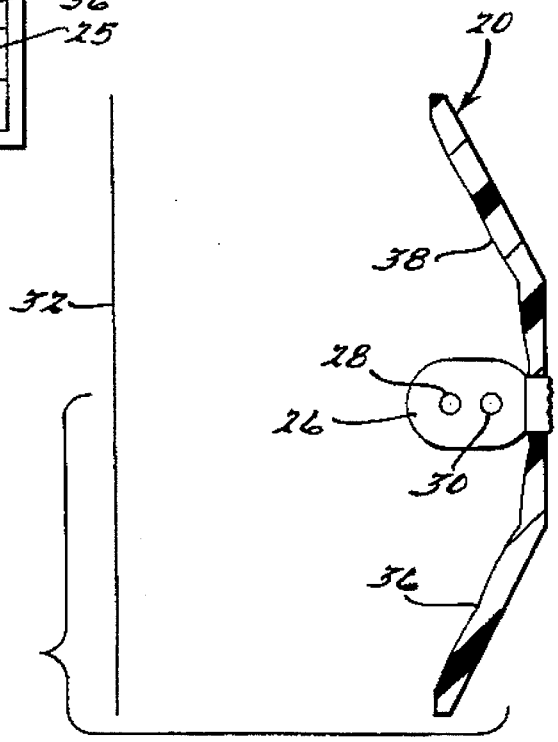
FIG. 3 is a cross sectional view of an a portion of a reflective surface in relation to an image screen.

Referring now to FIGS. 2 and 3, headlamp assembly 12 has a housing 20, a reflective surface 24 and a light source 26. Reflective surface 24 is formed of a plurality of facets 22. Reflecting surface 24 is a generally concave, curved surface which fits within the given package design constraints. For simplicity, the outer shape is shown as a rectangle, however, other shapes such as an oval (shown by dashed line 29), circle or other aesthetically pleasing design may be used.

Each of the individual facets 22 is generally rectangular in shape and has a generally smooth and continuous, curved facet surface 38 without discontinuities. The shape of the facet will be described in more detail in conjunction with FIG. 4 below. The facet surface 38 of each of the individual facets 22 are bounded by facet edges 36. If the reflector design is used for a headlamp of an automobile, edges 36 are preferably designed so that they are either parallel or normal to the plane of the road (not shown). However, they may also be placed in an angular relation to the plane of the road.

Facets 22 combine to form reflecting surface 24. Each pair of adjacent facets preferably has a common facet edge 36 which form common transition edges or points to thereby eliminate discontinuities between facets.

Facets 22 are molded into housing 20 which is typically made of plastic. After the housing is molded, a reflective coating 25 is sprayed on the surface of facets 22. Reflective coating 25 is typically a material such as aluminum and is commonly known in the art.

Headlamp assembly 12 has a bulb 26 carried in a fixed spatial relation to reflecting surface 24. In an automotive vehicle a high beam and a low beam lamp are provided. One such method of implementing both the high beam and low beam into a vehicle is by providing a single bulb 26 with two filaments; a high beam filament 28 and a low beam filament 30. High beam filament 28 and low beam filament 30 are fixed in a predetermined relation with reflecting surface 24 so that light generated from each of the filaments is reflected from reflecting surface 24 to an image surface 32 in a known manner as further described below.

Figure 4:
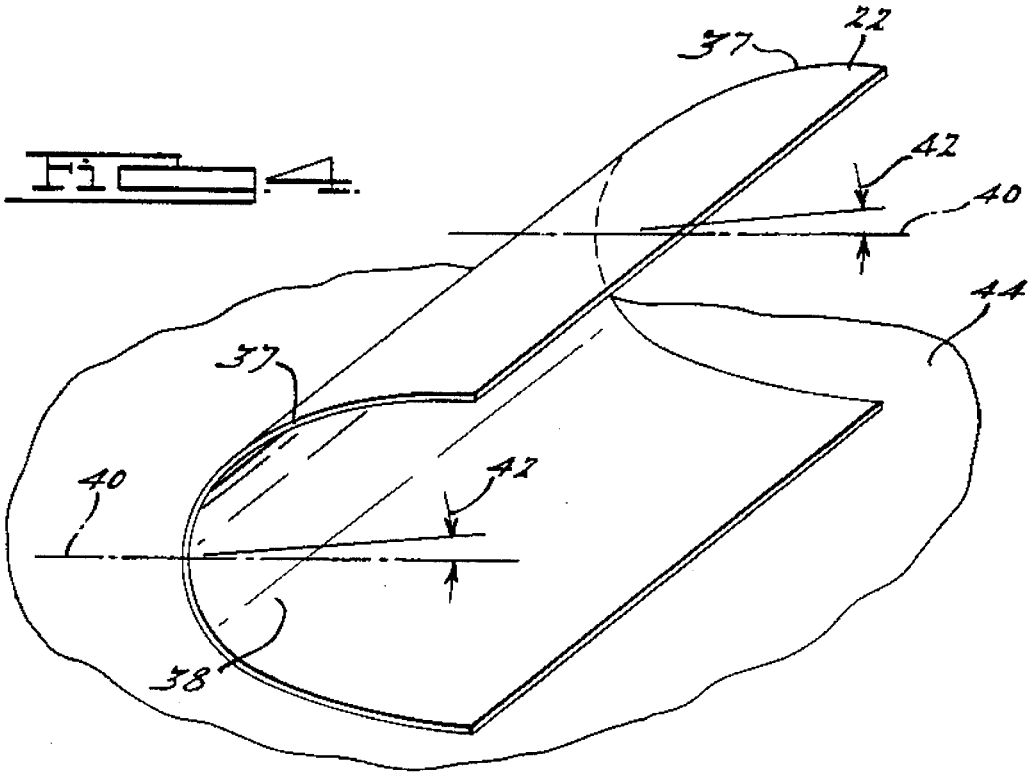
FIG. 4 is a regular parabolic cylinder.

Referring now to FIG. 4, a single facet 22 is shown having a typical parabolic facet surface without differential tilting. The parabolic shape of vertical edges 37 of facet 22 each have a focal axis 40 with the same angle of inclination 42 with respect to a horizontal plane 44.

Figure 5:
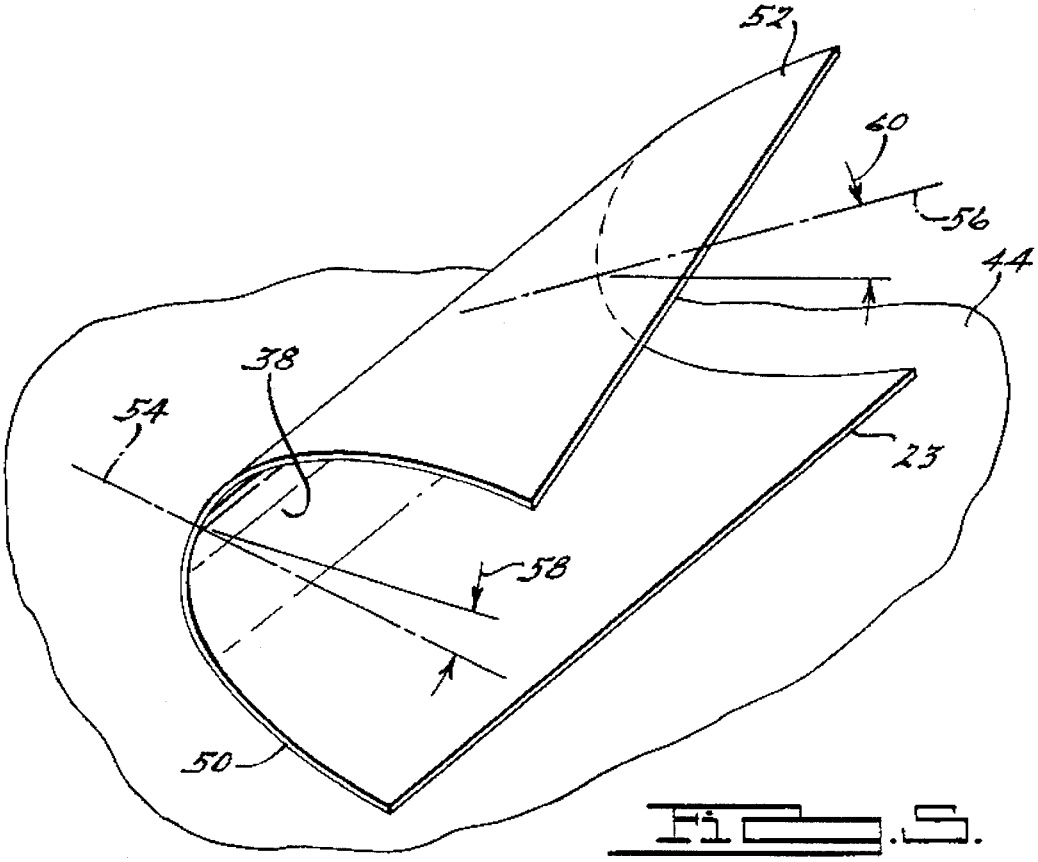
FIG. 5 is a differentially tilted parabolic cylinder.
Figure 1:
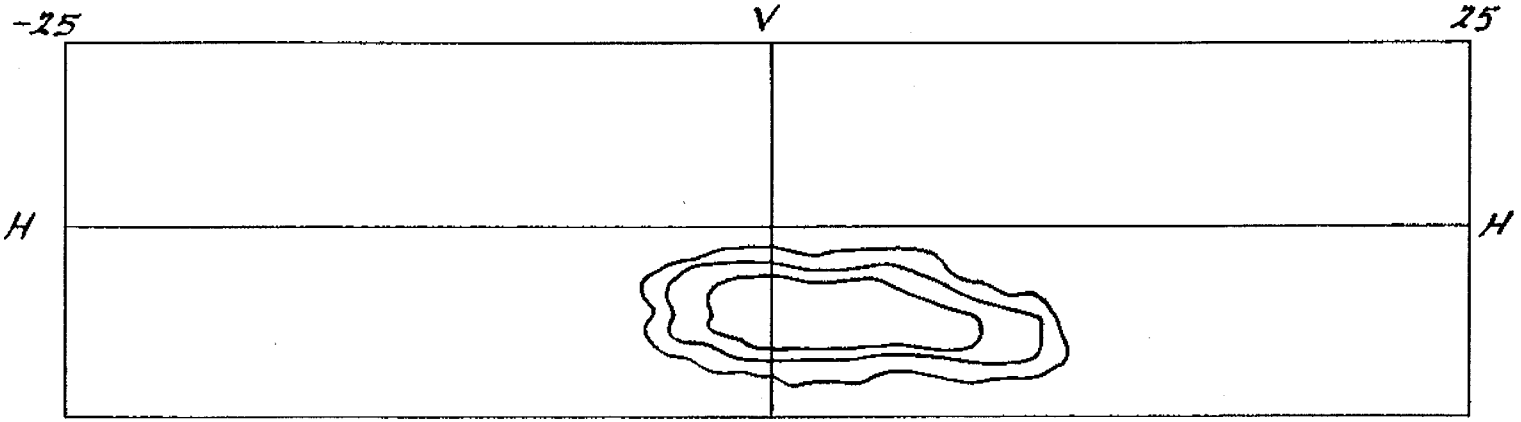
Figure 2:
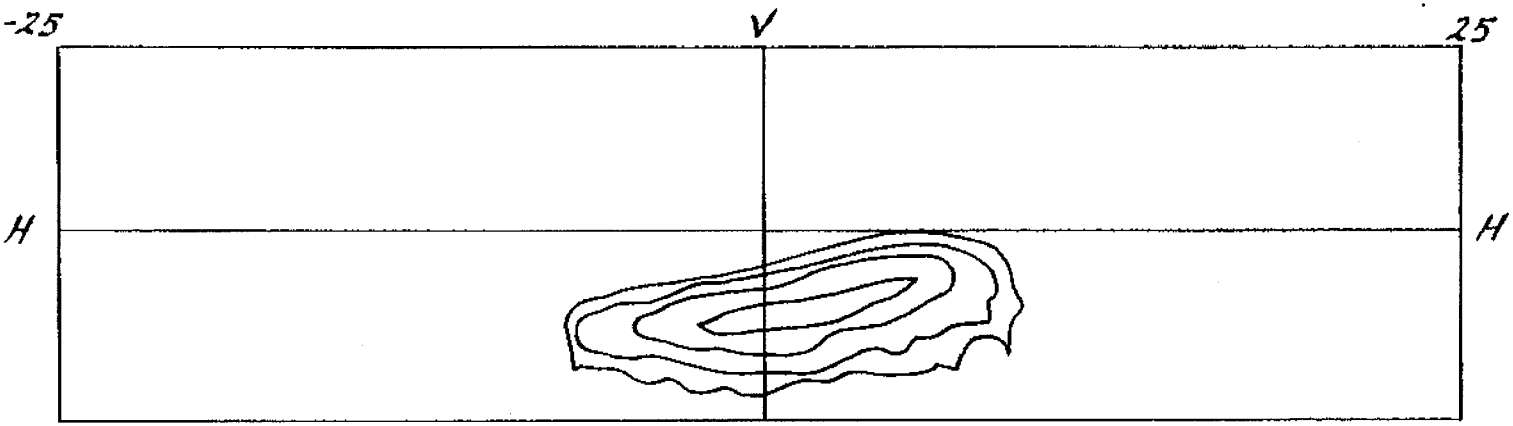

Referring now to FIG. 5, a single facet 23 has a facet surface 38 having a differentially tilted parabolic cross section. Each vertical edge 50 and 52 has a focal axis 54 and 56, respectively. Focal axis 54 and 56 each have a distinct predetermined angle of inclination 58 and 60 with respect to horizontal plane 44. Between the vertical edges 50 and 52, i.e the length of the facet, the facet has a smooth transition, i.e, the angle of inclination varies without discontinuity. Each facet in a headlamp may be formed with differentially tilted parabolic facets, however, conventional facets may be interspersed depending on the particular light output requirements of the vehicle. Using differentially tilted parabolic facets has been found to substantially increase the distance of forward illumination of a headlamp without increasing glare.

Angle 58 is shown as being below the horizontal plane while angle 60 is slightly above the horizontal plane. It will be understood by one in the art that both angles may be below the horizontal plane by different amounts. It has been found that an angle of-one to two degrees provides acceptable results.

By using a differentially tilted facet, the edges of one facet may be concurrent with the edges of each of its adjacent facets.

In a headlamp design, the reflective surface may contain an array of irregularly shaped facets derived from the surface of a rectangular facet.

Referring now to FIG. 6, a cumulative light distribution plot shows the light distribution of low beam filament obtained using regular parabolic facets.

Referring now to FIG. 7, a cumulative light distribution plot shows the light distribution of low beam filament obtained using differentially tilted parabolic facets. Governmental bodies typically have certain criteria on light distribution. The present invention allows a lighting designer to manipulate the facets within the design constraints of the automotive vehicle while maintaining the requisite governmental light distribution standard.

As is apparent when comparing FIGS. 6 and 7, more control of the light pattern is afforded using facets having a surface with differentially tilted parabolic facets. The surface is broken into larger facets that may be used in composite headlamps to reduces glare due to imperfections in tooling.

The present invention is intended to include modifications which would be apparent to those skilled in the art. For example, the actual implementation of the reflective surface may find applications such as tail lamps, cornering lamps, turn signal indicators or interior applications.

What is claimed is:

1. A lamp for an automotive vehicle comprising:

a reflecting surface having a plurality of adjacent facets, each facet having a length;

a light source placed in a predetermined spatial relationship to said reflecting surface;

at least one of said facets having a differentially tilted parabolic cross section.

2. A lamp as recited in claim 1 wherein said differentially tilted parabolic facet has a continuous and smooth surface with a focal axis having an angle of inclination with respect to the horizontal image surface that changes along said length of said facet.

3. A lamp as recited in claim 1 wherein said facet is bounded by horizontal and vertical edges.

4. A lamp as recited in claim 3 wherein said differentially tilted parabolic facet has a continuous and smooth surface with a focal axis having an angle of inclination with respect to a horizontal plane.

5. A lamp as recited in claim 1 wherein said light source comprises a high beam filament and a low beam filament, each of said filaments placed in a predetermined spatial relationship with said reflecting surface.

6. A headlamp for an automotive vehicle comprising;

a generally concave housing;

a reflecting surface within said housing having a plurality of adjacent facets;

a light source placed in a predetermined spatial relationship to said reflecting surface; and a protective cover enclosing said light source within said housing;

at least one of said facets having a differentially tilted parabolic cross section.

7. A headlamp as recited in claim 6 wherein said differentially tilted parabolic facet has a continuous and smooth surface with a focal axis having an angle of inclination with respect to the horizontal image surface that changes along a length of said facet.

8. A headlamp as recited in claim 6 wherein said facet is bounded by horizontal and vertical edges.

9. A headlamp as recited in claim 8 wherein said differentially tilted parabolic facet has a continuous and smooth surface with a focal axis having an angle of inclination with respect to the horizontal image surface that changes between said vertical edges.

10. A headlamp as recited in claim 6 further comprising a transparent cover secured to said housing covering said reflecting surface.

11. A headlamp for an automotive vehicle comprising;

a generally concave housing;

a reflecting surface within said housing having a plurality of adjacent facets bounded by edges;

a light source placed in a predetermined spatial relationship to said reflecting surface;

and a protective cover enclosing said light source within said housing;

at least one of said facets having a differentially tilted parabolic cross section, wherein said differentially tilted parabolic facet has a continuous and smooth surface with a focal axis having an angle of inclination with respect to a horizontal plane that changes continuously over a length of said facet;

each of said edges concurrent with edges of an adjacent facet.

12. A headlamp as recited in claim 11 further comprising a transparent cover secured to said housing covering said reflecting surface.

* * * * *